US011515637B2

(12) United States Patent
Ghiotto et al.

(10) Patent No.: US 11,515,637 B2
(45) Date of Patent: Nov. 29, 2022

(54) LEAKY WAVE ANTENNA IN AFSIW TECHNOLOGY

(71) Applicants: THALES, Courbevoie (FR); UNIVERSITE DE BORDEAUX, Bordeaux (FR); INSTITUT POLYTECHNIQUE DE BORDEAUX, Talence (FR); CENTRE NATIONAL DE LA RECHERCHE SCIENTIFIQUE, Paris (FR)

(72) Inventors: Anthony Ghiotto, Talence (FR); Ryan Raimond, Merignac (FR); Thierry Mazeau, Merignac (FR)

(73) Assignees: THALES, Courbevoie (FR); UNIVERSITE DE BORDEAUX, Bordeaux (FR); INSTITUT POLYTECHNIQUE DE BORDEAUX, Talence (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 0 days.

(21) Appl. No.: 17/125,757

(22) Filed: Dec. 17, 2020

(65) Prior Publication Data

US 2021/0184361 A1 Jun. 17, 2021

(30) Foreign Application Priority Data

Dec. 17, 2019 (FR) ..... FR1914577

(51) Int. Cl.
*H01Q 13/22* (2006.01)
*H01Q 13/28* (2006.01)

(52) U.S. Cl.
CPC ..... *H01Q 13/22* (2013.01); *H01Q 13/28* (2013.01)

(58) Field of Classification Search
CPC ..... H01Q 13/20; H01Q 13/22; H01Q 13/28
See application file for complete search history.

(56) References Cited

U.S. PATENT DOCUMENTS 4,334,229 A * 6/1982 Boblett ..... H01Q 13/22 343/767
2021/0249784 A1* 8/2021 Alexanian ..... H04B 1/109

OTHER PUBLICATIONS

Foreign Communication from a Related Counterpart Application, French Search Report and Written Opinion dated Sep. 24, 2020, French Application No. 1914577 filed on Dec. 17, 2019.

(Continued)

*Primary Examiner* — Daniel Munoz

(57) ABSTRACT

Leaky wave antenna of AFSIW structure comprising a top substrate layer and a bottom substrate layer sandwiching an intermediate layer comprising a longitudinal aperture of length L defining a waveguide and whose width W1 is delimited by two conductive lateral walls. The inner faces of the conductive lateral walls are coated with a layer of dielectric material of thickness w(z). The top layer has a longitudinal radiating slot of width Wf (z) facing the longitudinal aperture of the intermediate layer. The thickness w(z) of the dielectric coating varies along the longitudinal axis z according to a given law, defined so as to obtain variations along the axis z of the amplitude Alpha(z) and of the phase Beta(z) of the leaky wave of the guide.

12 Claims, 6 Drawing Sheets

(56) References Cited

OTHER PUBLICATIONS

Van Den Brande Quinten, et al.: "Coupled Half-Mode Cavity-Backed Slot Antenna for IR-UWB in Air-Filled SIW Technology", 2018 IEEE International Symposium on Antennas and Propagation & USNC/URSI National Radio Science Meeting, IEEE, Jul. 8, 2018 (Jul. 8, 2018), pp. 1269-1270, XP033496930, DOI: 10.1109/APUSNCURSINRSM.2018.8609106.

Chang Le, et al.: "Air-Filled Long Slot Leaky-Wave Antenna Based on Folded Half-Mode Waveguide Using Silicon Bulk Micromachining Technology for Millimeter-Wave Band", IEEE Transactions on Antennas and Propagation, IEEE Service Center, Pscataway, NJ, US, vol. 65, No. 7, May 2, 2017, pp. 3409-3418, XP011655706, ISSN: 0018-926X, DOI: 10.1109/TAP.2017.2700040.

Oraizi H., et al.: "X-Band Slot Antenna Array in Air-Filled Substrate Integrated Waveguide", 2019 49th European Microwave Conference (EUMC), European Microwave Association (EUMA), Nov. 25, 2019, pp. 153-156, XP033641861, DOI: 10.23919/EUMC.2019.8910786.

Yu Jian Cheng, et al.: "Millimeter-Wave Substrate Integrated Waveguide Long Slot Leaky-Wave Antennas and Two-Dimensional Multibeam Applications", IEEE Transactions on Antennas and Propagation., vol. 59, No. 1, Jan. 1, 2011, pp. 40-47, XP055728603, US ISSN 0018-926X, DOI 10.1109/TAP.2010.2090471.

* cited by examiner

LEAKY WAVE ANTENNA IN AFSIW TECHNOLOGY

FIELD OF THE INVENTION

The present application claims priority to French Application No. 1914577 filed with the Intellectual Property Office of France on Dec. 17, 2019 which is incorporated herein by reference in its entirety for all purposes.

FIELD OF THE INVENTION

The invention relates to the general field of microwave antennas used in radars and telecommunications. It relates more particularly to the field of array antennas or leaky wave antennas.

CONTEXT OF THE INVENTION—PRIOR ART

The leaky wave antennas in metallic waveguide technology are broadly described in the literature. FIG. 1 presents an outline illustration of the principle of production of such an antenna 10 by means of slotted waveguides 11.

Such antennas are however difficult to manufacture and costly because of the issue of assembly and production accuracy.

In order to reduce the manufacturing costs and obtain integrated leaky wave antennas, it is also known practice to implement the substrate integrated waveguide technology (SIW). FIG. 2 presents an illustration of the structure of such an antenna.

Radiating slotted antennas produced by implementing such a technology offer, by comparison to the other technologies employed, the advantage of being compact, lightweight and easy to produce. They can advantageously be mounted on equipment for which the criteria of weight and of bulk are predominant.

However, the slotted antennas, produced by implementing this technology have the known drawback of exhibiting significant dielectric losses. Consequently, to compensate for these losses the amplification functions associated with the antenna have to be overdimensioned, which is reflected in an increase in overall weight of the system associated with the antenna, such that the weight saving provided by the use of a planar antenna is reduced by the increase in weight induced by the need to include means to compensate for the dielectric losses.

Moreover, overdimensioning the amplification functions is reflected by an increase in the energy consumption of the system.

Consequently, there is currently a need to find a solution allowing for the production of leaky wave antennas, with planar structure, that exhibit enhanced (i.e. reduced) dielectric losses compared to the antennas in existing planar technologies, in SIW technology in particular.

Recently, hollow substrate, or air-filled substrate integrated waveguide technology (AFSIW) has emerged. It allows guided transmission lines (i.e. waveguides) to be produced that exhibit enhanced performance levels compared to the transmission lines integrated in a substrate of SIW type. Such waveguides can be referred to as AFSIW waveguides.

SUMMARY OF THE INVENTION

One aim of the invention is to provide a solution to the problem of finding a solution allowing for the design and production of antennas on substrates that can reconcile operating performance levels in terms of radiating pattern with limited dielectric losses.

To this end, the subject of the invention is a leaky wave antenna produced in air-filled substrate integrated waveguide (AFSIW) technology comprising three dielectric substrate layers, two substrate layers, a top layer and a bottom layer, sandwiching an intermediate layer which itself comprises a longitudinal aperture of length L defining a waveguide whose top and bottom walls are formed by the conductive planes covering the top and bottom layers and whose width W1 is delimited by two conductive lateral walls.

According to the invention, the inner faces of the conductive lateral walls are coated with a layer of dielectric material of thickness w(z). The top layer of the structure has an aperture forming a longitudinal radial slot of width Wf (z) positioned facing the longitudinal aperture formed in the intermediate layer.

The thickness w(z) of the coating of dielectric material disposed on the inner face of each of the lateral walls varies along the longitudinal axis z according to a given law, defined so as to obtain variations along the axis z of the amplitude Alpha(z) and of the phase Beta(z) of the leaky wave of the guide, allowing the production of an antenna having the desired radiating pattern.

According to various provisions, the antenna according to the invention can have various of the following complementary technical features, which in each case can be considered separately or in combination.

According to a particular feature, the law of variation w(z) of the thickness of dielectric substrate bordering the inner face of each of the lateral walls of the cavity of the AFSIW guide is a linear law.

According to another feature, the thicknesses of dielectric substrate bordering the inner face of each of the lateral walls of the cavity of the AFSIW guide follow one and the same law of variation w(z).

According to another feature, the thickness of dielectric substrate bordering the inner face of one of the lateral walls of the cavity of the AFSIW guide follows a linear law of variation w(z), the thickness of dielectric substrate bordering the inner face of the other lateral wall of the AFSIW guide being kept constant, even zero.

According to another feature, the median axis of the radiating slot is distant from the median axis of the cavity of the guide by a zero or non-zero given distance d.

According to another feature, the distance d(z) separating the median axis of the radiating slot from the median axis of the cavity of the guide varies according to a law d(z) along the longitudinal axis z of the antenna.

The distance separating the median axis of the radiating slot from the median axis of the cavity of the guide is taken on an axis at right angles to the axis z and at right angles to an axis of stacking of the three layers of dielectric substrate.

According to another feature, the radiating slot is a rectangular slot of constant width wf.

According to another feature, the radiating slot is a slot whose width Wf(z) varies along the longitudinal axis z of the guide.

According to another feature, the total width W1 of the guide along the longitudinal axis z of the antenna is defined as a function W1(*z*).

According to another feature, the longitudinal aperture of the intermediate layer forming the cavity of the waveguide is delimited by the conductive planes covering the bottom and top layers and by two conductive walls each composed of a row of vias in electrical contact with said conductive planes and forming the conductive lateral walls of said waveguide, each of said rows of vias being disposed so as to form one of the lateral walls of the guide, the inner face of the wall thus formed being coated with a layer of dielectric material of thickness w(z).

According to another feature, the longitudinal aperture of the intermediate layer forming the cavity of the waveguide is delimited by the conductive planes covering the bottom and top layers and by two conductive walls forming the lateral walls of said waveguide; one of the two walls being composed of a row of vias in electrical contact with said conductive planes, said row of vias being disposed so that the inner face of the wall thus formed is coated with a layer of dielectric material of thickness w(z).

The device according to the invention which applies the emergent technology of AFSIW waveguides advantageously allows the production of leaky waveguides that have dimensions, a weight and a cost that are enhanced compared to the existing antennas, the traditional slotted waveguide antennas in particular, by using simple and robust manufacturing techniques, while keeping good performance levels.

DESCRIPTION OF THE FIGURES

The features and advantages of the invention will be better appreciated from the following description, a description which is based on the attached figures which illustrate the invention.

DETAILED DESCRIPTION

The recently developed air-filled substrate integrated waveguide (AFSIW) technology has only recently been used to produce guided transmission lines on a substrate. Hereinafter in the text, such a structure is qualified as "AFSIW waveguide".

Figure 2:
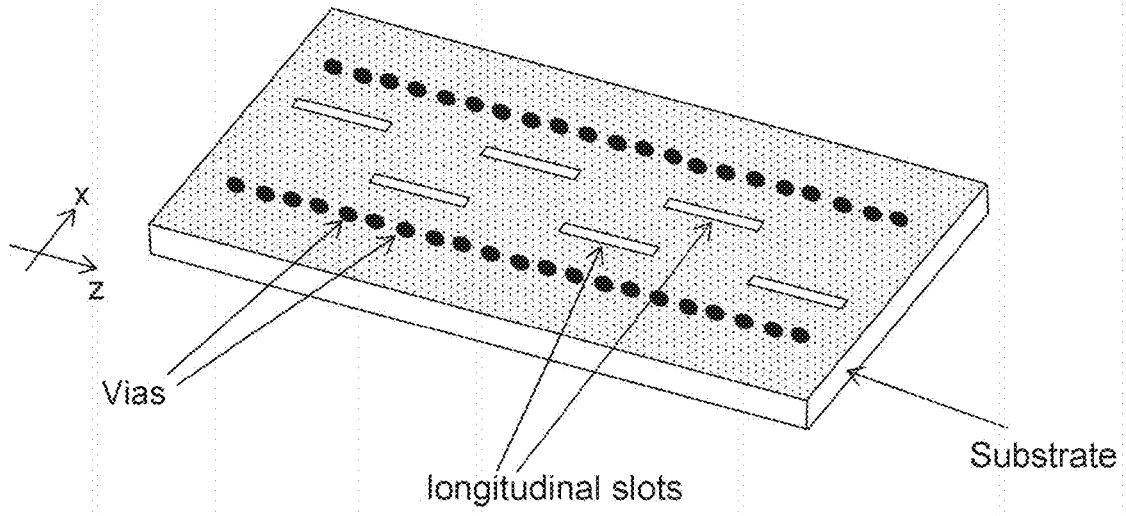
FIG. 2 already described, schematically represents a known SIW-type planar structure.

This technology advantageously allows guided transmission lines to be obtained that exhibit enhanced performance levels, notably in terms of dielectric losses, compared to the structures in SIW technology used hitherto, structures illustrated by FIG. 2.

Figure 1:
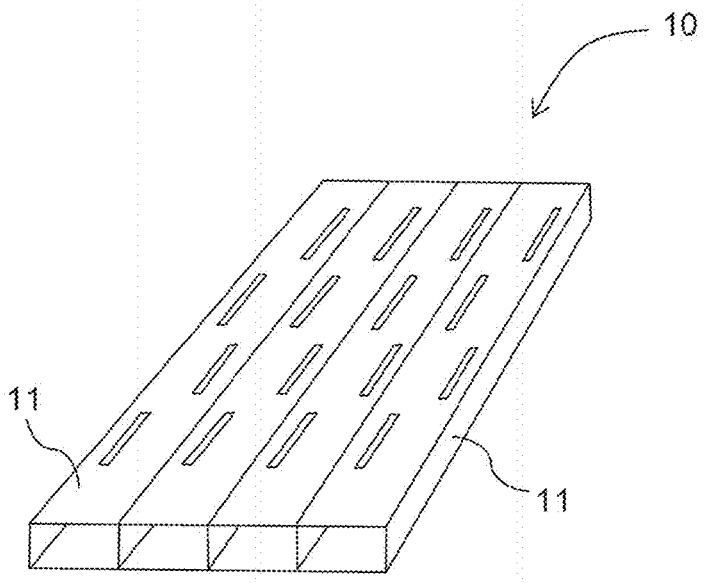
FIG. 1 already described, schematically represents the structure of a slotted array antenna according to the prior art.

Compared to the structures of metal waveguide type, illustrated by FIG. 1, such transmission lines also exhibit advantageous characteristics in terms of weight and bulk.

From the technological point of view, the leaky wave antenna according to the invention relies on the AFSIW waveguide production technology.

Figure 3A:
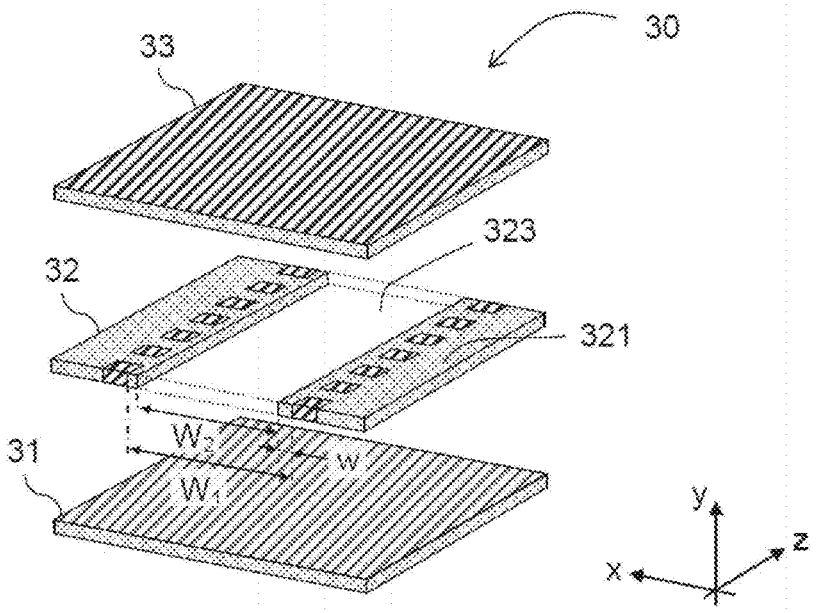
FIG. 3A schematically represents, in profile view, the standard three-layer structure of a waveguide produced in AFSIW (i.e. Air-Filled Substrate Integrated Waveguide) technology.
Figure 3B:
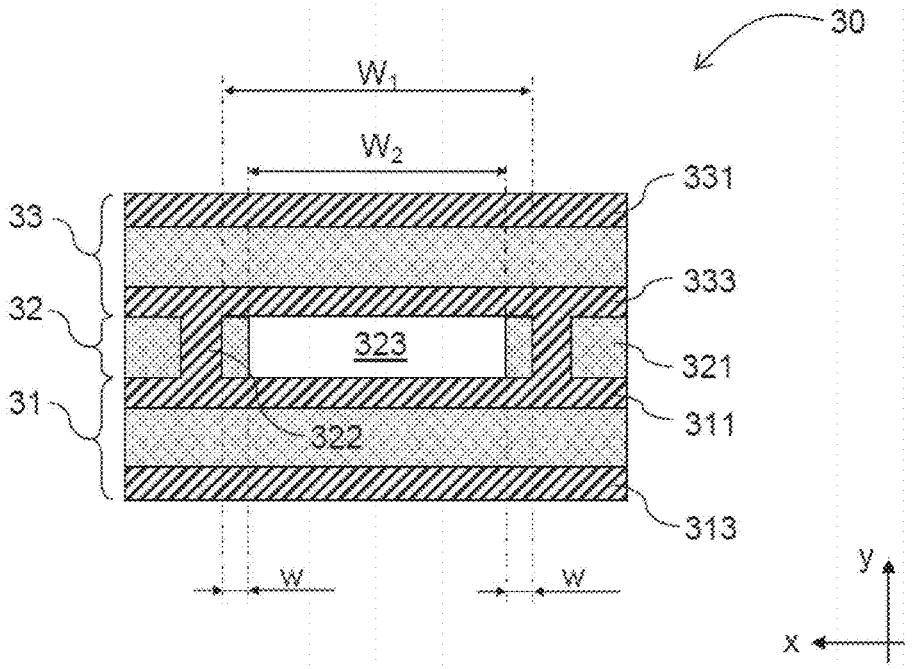
FIG. 3B schematically represents, in a cross-sectional view, the standard three-layer structure of a waveguide produced in AFSIW (i.e. Air-Filled Substrate Integrated Waveguide) technology according to the invention.

As FIGS. 3A and 3B, profile view and a cross-sectional view respectively, illustrate, the structure of an AFSIW waveguide comprises three dielectric substrate layers, an intermediate substrate layer (layer no. 2) that has a central longitudinal void 32, of length L and of width W2, sandwiched between a bottom substrate layer 31 (layer no. 1) and a top substrate layer 33 (layer no. 3); the substrate layers no. 1 and no. 3 close the top and bottom walls (large sides) of the waveguide.

The three dielectric substrate layers are stacked on an axis y.

In a conventional AFSIW structure, the layers no. 1 and no. 3 have an identical structure composed of a dielectric substrate whose inner and outer surfaces are covered by metallized planes (conductive planes), the planes 311 and 313 for the layer no. 1 and 331 and 333 for the layer no. 3 respectively.

The central longitudinal void 323, constituting the cavity of the guide, is bordered laterally by two rows of conductive vias, or simply vias, 322, which pass right through the dielectric substrate layer and allow an electrical continuity to be ensured between the inner conductive planes of the top and bottom layers. These rows of vias form the lateral walls (small sides) of the waveguide.

According to the invention, each of said rows of vias is disposed so as to form a layer of dielectric material of thickness w(z) bordering the inner face of the lateral wall of the guide defined by the row of vias considered; such that the AFSIW waveguide thus constituted has lateral walls (small sides) coated with a layer of dielectric substrate of thickness w(z).

The thickness of the dielectric substrate layer is taken on an axis x at right angles to the axis y and to the axis z along which the waveguide extends.

The AFSIW waveguide thus formed thus has a width W1=W2+2 w.

According to the invention, the total width W1 is determined so as to allow the propagation of waves at the desired operating frequency.

The vias 322 are, moreover, generally arranged so that the thickness w(z) of substrate bordering the lateral walls of the guide is as small as possible in order to minimize the dielectric losses in the guide.

The structure of the AFSIW waveguide considered preferentially in the context of the antenna according to the invention is a structure conforming to FIGS. 3A and 3B. Such a structure in fact advantageously allows the properties of the wave which is propagated inside the duly formed guide to be modified.

However, it should be noted that it is possible, through the AFSIW technique, to construct waveguide structures that do not have dielectric on their lateral walls, notably by producing a continuous metallization of these walls.

In this case, a structure equivalent to the structure of FIGS. 3A and 3B can nevertheless be envisaged, in the context of the invention, by arranging, in the cavity 323 of the guide on each of the lateral walls (small sides) of the guide, a layer of dielectric material of thickness w(z) that, as in the preceding case, allows the properties of the wave which is propagated inside the guide that is formed to be modified.

Figure 4A:
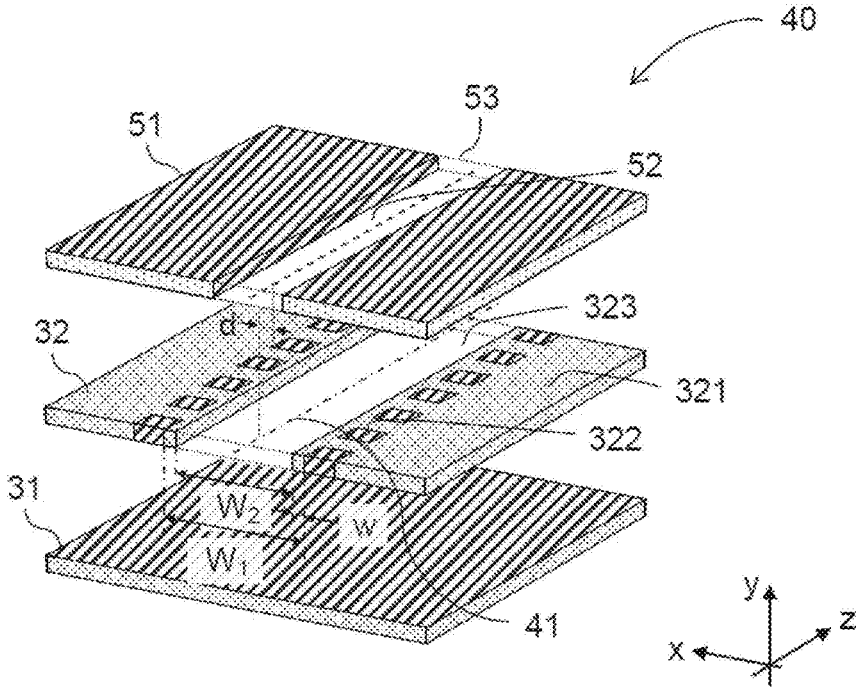
FIG. 4A schematically represents, in profile view, the typical structure of a leaky wave antenna in AFSIW technology according to the invention.
Figure 4B:
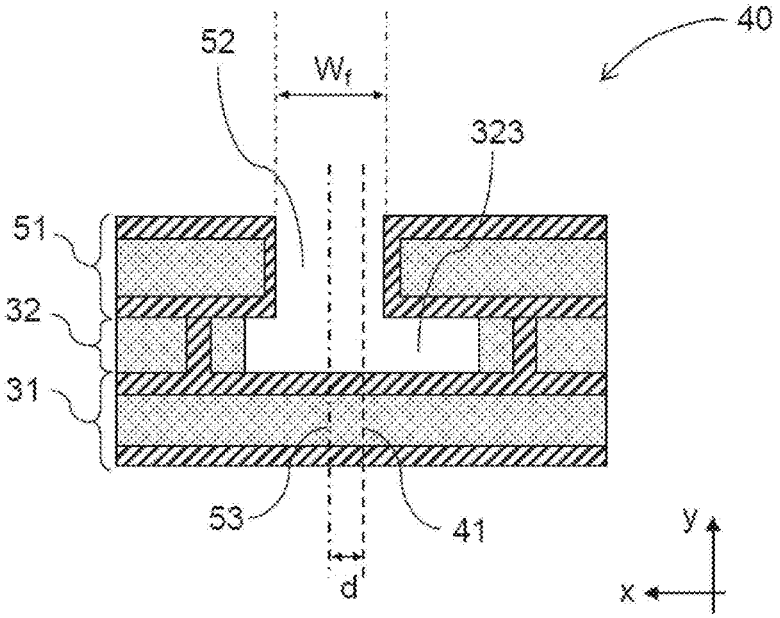
FIG. 4B schematically represents, in a cross-sectional view, the typical structure of a leaky wave antenna in AFSIW technology according to the invention.

FIGS. 4A and 4B, a profile view and a cross-sectional view respectively, schematically present the antenna structure according to the invention, according to an embodiment for which the lateral walls (small sides) of the AFSIW guide are produced by means of vias.

Generally, the structure of the antenna according to the invention comprises, unlike an AFSIW waveguide structure, a top substrate layer 51 (layer no. 3) having at least one longitudinal slot 52 (oriented along the axis z) placed facing the cavity 323 of the median substrate layer 32 (layer no. 2).

This slot, of width Wf, which passes right through the top substrate layer connects the cavity 323 of the guide with the outside environment.

In order to allow the radiation of a leaky wave, the longitudinal slot 52 typically has a length, along the axis z, greater than or equal to twice the operating wavelength of the antenna, that is to say of the wavelength of the radiated wave.

The slot is positioned with respect to the cavity so as to be radiating, that is to say so as to radiate the wave which is propagated in the guide.

To this end, the median axis 53 of the slot 52 is, advantageously, positioned with respect to the median axis 41 of the cavity 323 of the guide so as to radiate the wave which is propagated in the guide.

In the nonlimiting embodiment of FIGS. 4A and 4B, the longitudinal slot 52 is disposed so that its median axis 53 is offset by a distance d with respect to the median axis 41 of the cavity 323 of the guide.

The distance d is the distance separating, in the direction x, the median axis 53 of the slot 52 from the median axis 41 of the cavity 41.

The distance d is non-zero in the embodiment of FIGS. 4A and 4B.

The longitudinal slot 52 thus formed makes it possible to produce, from an AFSIW guide, a slotted guide capable of radiating the wave which is propagated therein.

As a variant, the distance d is zero. That can, for example, be the case in a particular embodiment in which the thicknesses of dielectric material disposed on the two lateral walls of the cavity 323 are different.

According to the invention, the various dimensioning parameters of the cavity 323 of the guide, in particular the widths W1 and w(z), and those which dimension the radiating slot 52, in particular the width Wf, are defined so as to produce an antenna whose radiating pattern exhibits a desired direction, aperture and level of given side lobes. In other words, these dimensional parameters are determined so as to obtain given laws of variation of the phase Beta(z) and of the amplitude Alpha(z) of the leaky wave of the AFSIW guide on the longitudinal axis z of the antenna according to the invention; the variation of the phase and of the amplitude on the axis z of the leaky wave of the AFSIW guide determining the radiation pattern obtained.

Thus, the invention consists primarily in determining the direction, the aperture, and the level of the side lobes of the pattern of the AFSIW antenna that is to be produced by acting on these Alpha(z) and Beta(z) parameters.

The rest of the description explains different embodiments of the invention according to which one or more dimensional parameters which define the AFSIW waveguide with radiating slot that constitutes the antenna according to the invention are adjusted, so as to obtain the desired radiation pattern, by varying, along the axis z, the phase Beta(z) and the amplitude Alpha(z) of the wave passing through the waveguide.

Figure 5:
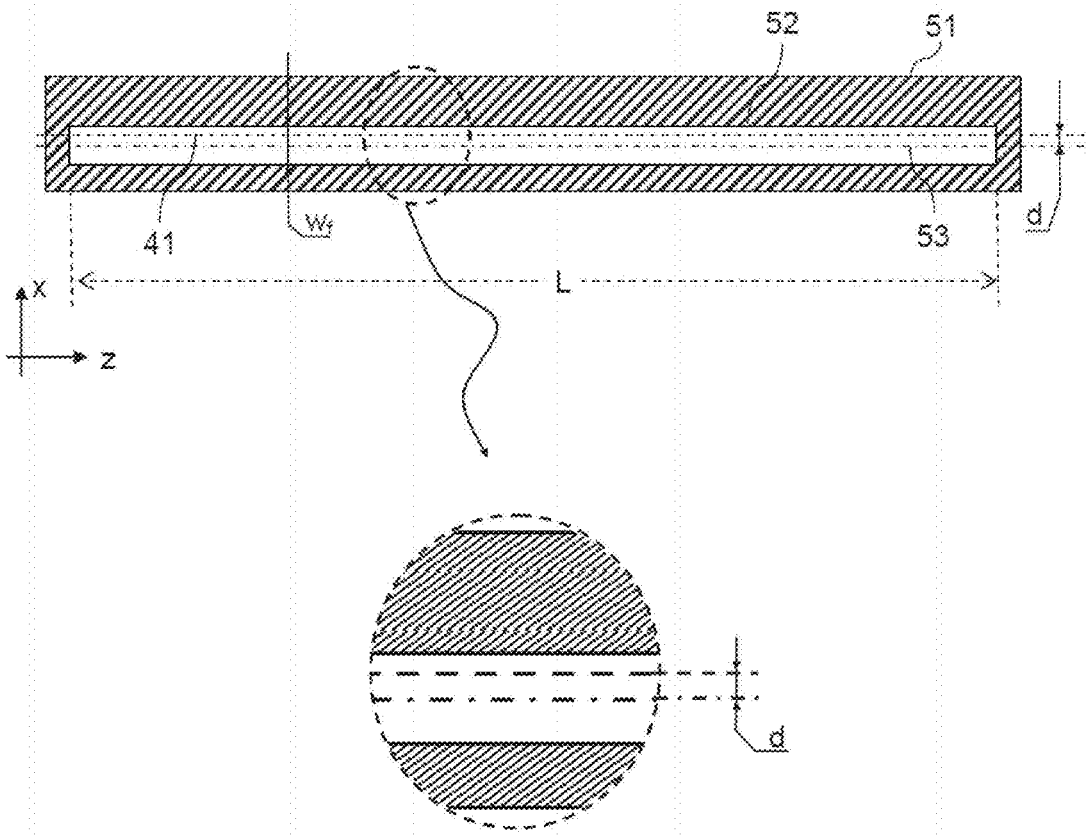
FIG. 5 schematically represents, in plan view, the third substrate layer forming the AFSIW structure of the antenna according to the invention, in a particular embodiment.
Figure 6:
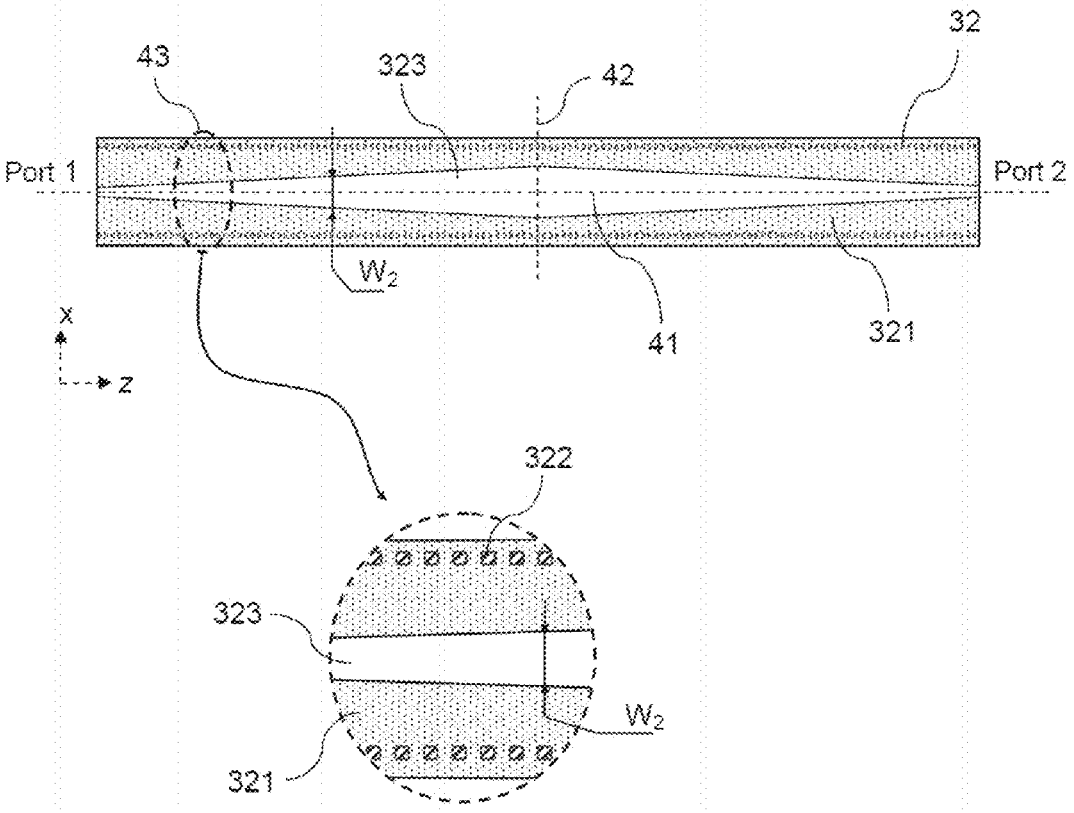
FIG. 6 schematically represents a plan view of the second substrate layer forming the AFSIW structure of the antenna according to the invention, in the particular embodiment of FIG. 5.

FIGS. 5 and 6 illustrate a particular embodiment taken as nonlimiting example of the scope of the invention. They respectively present a plan view of the intermediate substrate layer 32 (layer no. 2) forming the cavity 323 of the guide and a plan view of the top substrate layer 51 (layer no. 3), layers which constitute the AFSIW structure of the antenna according to the invention.

To obtain an AFSIW antenna according to the invention that exhibits a radiation pattern having the desired characteristics (gain, directivity and level of side lobes in particular), it is notably possible to adjust the following parameters:

a. the length of the antenna L, which allows the gain of the antenna and the angular aperture of its radiation pattern to be adjusted, a higher gain and a smaller angular aperture being able to be obtained with a longer antenna and radiating slot
b. the width, W1, of the AFSIW line which determines the total width of the waveguide,
c. the W2 and w pairing determines the cutoff frequency of the fundamental mode of the waveguide. It may be necessary to reduce W2 when w is increased in order to keep the same cutoff frequency of the fundamental mode;
d. the width, Wf, of the slot 52 formed in the top substrate layer 51 (layer no. 2);
e. the distance d, from the longitudinal axis 53 of the slot 52 with respect to the longitudinal axis 41 of the cavity 323.

However, in the case of the device according to the invention, the phase and the amplitude of the wave being propagated in the cavity 323 of the waveguide per unit of length, are controlled primarily by varying the value w of the thickness of dielectric substrate bordering the lateral walls of the cavity 323 of the guide along the longitudinal axis z, the value w of the thickness of dielectric substrate being thus defined as a function w(z).

Advantageously, the thickness w of dielectric substrate bordering the lateral walls of the cavity of the guide are varied, facing the radiating slot, along the axis z.

This control action advantageously allows the values of the parameters Alpha(z) and Beta(z) which determine the parameters defining the radiation pattern of the antenna to be controlled.

Indeed, varying the thickness of substrate bordering the lateral walls of the cavity 323 advantageously allows the phase per unit of length of the wave being propagated inside the cavity 323 of the device to be varied, the variation of phase of the wave being propagated along the cavity 323 facing the radiating slot 52 determining the orientation of the radiation pattern.

According to the embodiment considered, the variation of the width w can be done in different ways, depending on the antenna pattern desired.

Thus, according to a first embodiment, the width w of dielectric substrate bordering the lateral walls of the cavity 323 forming the AFSIW guide varies identically for each of the lateral walls.

Alternatively, according to another embodiment, the thickness w of dielectric substrate can vary according to different laws w1(*z*) and w2(*z*) along the longitudinal axis of the cavity 323. The thickness w of dielectric substrate can notably remain constant (w1(*z*)=cte) on one lateral wall of the cavity 323 and vary according to a given law of variation w2(*z*) l on the other lateral wall of the cavity.

FIGS. 5 and 6 present a first simple exemplary embodiment for which the parameters defining the radiation pattern are exclusively controlled by simply varying the value w of the thickness of substrate along the axis z.

The structure of the intermediate layer 32 (layer no. 2) is, here, perfectly symmetrical with respect to the centre of symmetry of the cavity 323 of the AFSIW slotted guide according to the invention.

The radiating slot 52 formed in the top substrate layer 51 appears as a slot of rectangular form of length L and of width Wf which has a constant value along the longitudinal axis z.

In the exemplary embodiment considered, the slot 52 passes right through the substrate layer no. 3, its lateral walls formed in the thickness of the substrate are also metallized by using the PCB metallization methods.

However, according to an alternative embodiment, the slot is etched on the metallized surfaces forming the outer faces of the substrate layer no. 3, the lateral walls of the slot then consisting of metallized vias passing through the thickness of the substrate.

The distance, d, from the axis of symmetry 53 of the slot 52 with respect to the axis of symmetry 41 of the cavity 323 also has a constant value along the longitudinal axis z.

Concerning the intermediate substrate layer 32 (layer no. 2), the total width W1 of the cavity 323 of the guide, the width between the two rows of vias bordering the cavity in the embodiment illustrated by FIGS. 4A, 4B, 5 and 6, is kept constant, at least over all the length of the cavity 323 of the intermediate substrate layer 32 facing the radiating slot 52;

Moreover, as FIG. 6 shows, the thickness w of dielectric substrate bordering the lateral walls of the cavity 323 varies identically, for each of the lateral walls, according to a law of variation w(z).

This law of variation can be a simple linear law as illustrated by FIG. 6. Such a law of variation allows a radiation pattern to be formed in the desired direction, a radiation pattern such as those, 71 and 72, presented according to a 2D (two-dimensional) representation in FIG. 7.

In the exemplary embodiment illustrated by FIGS. 5 and 6, the antenna produced is symmetrical in the direction x (same value w of thickness of dielectric material bordering the lateral faces of the cavity 323 of the guide) and the direction z (it has a plane of symmetry 42), with two access ports allowing the waves to be radiated or received according to two radiation patterns oriented in two directions forming opposite angles +θ and −θ with respect to the vertical plane passing through the axis of symmetry 53 of the radiating slot 52.

It is however possible to design an antenna with a single port and therefore a single direction of propagation. A non-symmetrical topology with a single supply port can in fact be implemented, by terminating the guide with a load.

It should be noted that, according to the invention, the law of variation w(z) considered can be more complex than a simple linear law, notably in order to reduce the level of the side lobes of the radiation pattern produced.

In the exemplary embodiment illustrated by FIGS. 5 and 6, the radiating slot 52 has a rectangular form of length L with a width Wf that is constant over all the length L. It is however possible, in the context of the invention, to envisage another embodiment of the invention: the radiating slot may not have a rectangular form.

In particular, a non-rectangular form allows a radiation pattern to be obtained that has given particular characteristics. Thus, by using, for example, a slot in the form of an "eye", it is possible to limit the radiated energy (i.e. the gain of the antenna) at the ends of the slot and maximize the radiated energy at the centre of the slot. The width of the slot 52 is then defined as a function of the position considered Wf(z) along the slot 52. It is in this way possible to produce a good spatial weighting of the law of illumination (i.e. of the radiation pattern) and obtain a radiation pattern that has reduced side lobes.

Moreover, in the exemplary embodiment illustrated by FIGS. 5 and 6, the distance d between the central axis 53 of the slot 52 with respect to the central axis 41 of the cavity 323 of the AFSIW line remains constant over all the length L of the antenna, the phase and the amplitude of the wave being propagated in the cavity 323 of the waveguide per unit of length being controlled by varying the value w of the thickness of substrate bordering the lateral walls of the cavity 323 of the guide along the longitudinal axis z, according to a function w(z).

It is however possible, in the context of the invention, to envisage another embodiment in which an adjustment of the radiation pattern of the antenna according to the invention can be obtained by also varying the distance d between the median axis 53 of the slot 52 with respect to the median axis 41 of the cavity 323 of the AFSIW line, the distance d being defined in this case as a function d(z) of the position considered along the slot 52.

As the paragraphs above explain, the structure of the device according to the invention advantageously allows a leaky wave antenna to be formed in AFSIW technology that is easy and inexpensive to produce, in which the radiation pattern can be defined by acting primarily on the thickness of dielectric substrate carpeting the lateral walls of the waveguide line formed by the AFSIW structure from which the antenna according to the invention is developed, and by varying in particular this thickness over the length of the transmission line (variation along the longitudinal axis z). The variation of the gain and of the phase per unit of length of the leaky wave of the radiating AFSIW guide, obtained by varying the thickness of substrate, advantageously allows the characteristics of the radiation pattern obtained to be determined.

Figure 7:
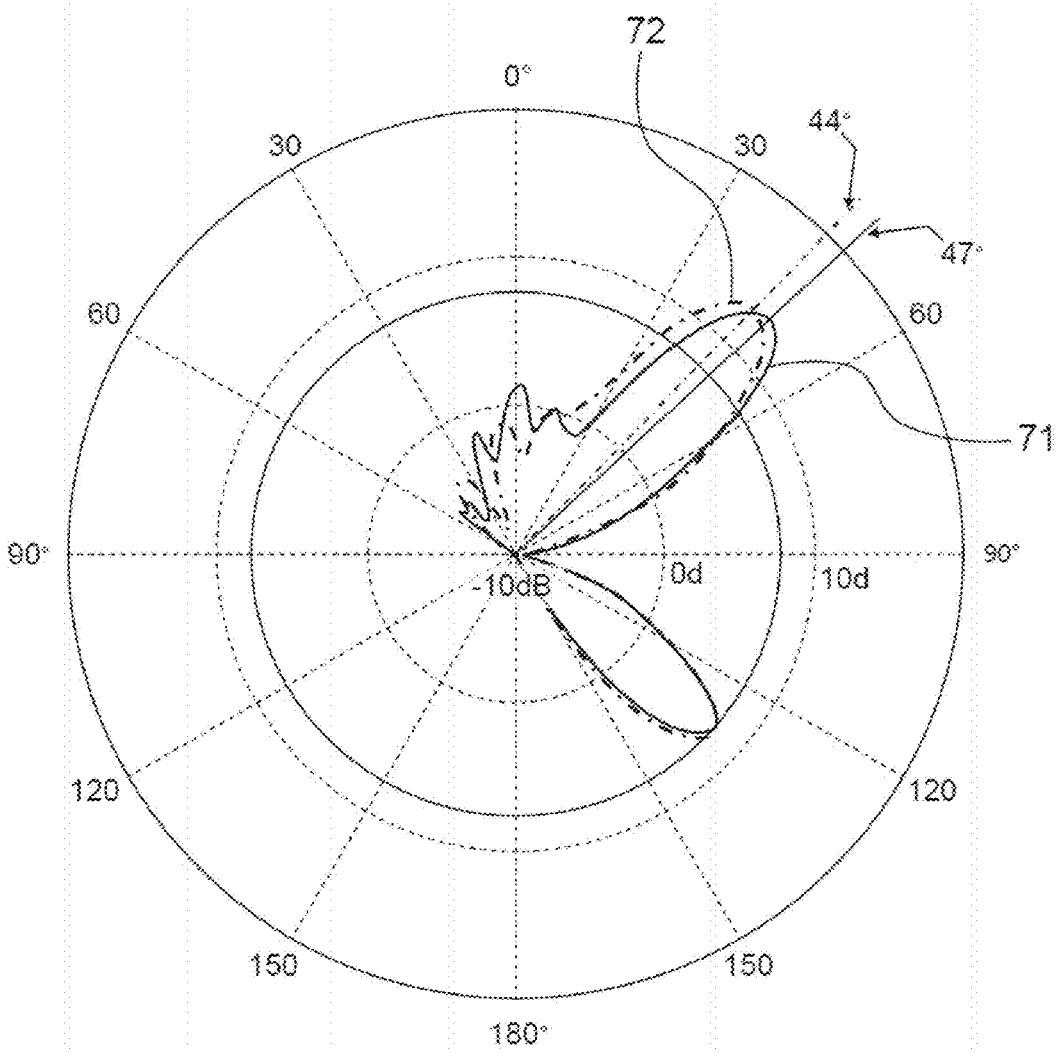
FIG. 7 represents examples of radiation patterns, projected in the plane yz; patterns obtained by means of an antenna according to the invention.

FIG. 7 presents the radiation patterns 71 and 72 obtained for two AFSIW antennas according to the invention, formed from AFSIW guides in which the lateral walls of the cavities 323 are coated with substrate layers whose thicknesses vary along z with different variation profiles. The radiation pattern 72 is obtained from a cavity having, on its lateral walls, a thickness of substrate w(z) that varies along the longitudinal axis z with a slope of variation that is greater than in the case of the radiation pattern 71.

It can be seen that, in the latter case, the slope of variation of the thickness w(z) being greater, the pattern obtained 72 approaches the vertical plane of the antenna whereas, reciprocally, narrowing the interior of the waveguide brings the beam increasingly parallel to the longitudinal axis of the antenna.

In the part of the description above, the device, the antenna, according to the invention, is defined by its basic AFSIW structure and by the dimensional characteristics which allow the different layers forming the AFSIW structure of the antenna to be defined. The technical characteristics described are the dimensional characteristics preferentially considered to produce an antenna according to the invention that exhibits the desired radiation pattern.

It is however possible to incorporate, with these various parameters, other dimensional and/or structural parameters in order, in particular, to have a greater latitude in the choice of the values of the dimensional parameters that allow an antenna structure exhibiting the radiation pattern sought to be obtained.

It is thus notably possible, in the context of the production of the antenna according to the invention, to act also on the total width W1 of the guide along the longitudinal axis z of the guide (direction of propagation of the wave) such that the total width of the guide is defined as a function W1(*z*)). There is thus an additional means for controlling the variation of the phase Beta(z) and of the amplitude Alpha(z) of the leaky wave along the longitudinal axis z of the antenna.

It is also possible to vary the width of the slot and/or the position of its axis of symmetry with respect to that of the cavity of the AFSIW guide in order to have an additional means of controlling the variation of the phase Alpha(z) and of the amplitude Beta(z) along the longitudinal axis z of the antenna.

It is even also possible to replace the continuous radiating slot 52 with several small slots, forming a network of slots disposed along the axis z of the antenna facing the cavity 323 of the guide.

From a functional point of view, the AFSIW antenna according to the invention appears as a device with two access ports, as FIGS. 4A and 4B illustrate, such that, depending on the manner in which it is used, it can advantageously have two radiation patterns oriented in two directions exhibiting opposite angles with respect to the vertical (use of ports 1 and 2) or else, alternatively, a single radiation pattern, one of the ports, unused, being terminated by a load.

The invention claimed is:

1. A Leaky wave antenna formed from a waveguide structure of AFSIW type comprising three dielectric substrate layers, two substrate layers, a top layer and a bottom layer, sandwiching an intermediate layer comprising a longitudinal aperture of length L defining a waveguide whose top and bottom walls are formed by the conductive planes covering the top and bottom layers and whose width $W_1$ is delimited by two conductive lateral walls, the inner faces of the conductive lateral walls being coated with a layer of dielectric material of thickness w(z); said antenna being characterized in that the top layer of the structure has an aperture forming a longitudinal radiating slot of width $W_f(z)$ positioned facing the longitudinal aperture formed in the intermediate layer, the thickness w(z) of the coating of dielectric material disposed on the inner face of each of the lateral walls varying along the longitudinal axis z according to a given law, defined so as to obtain variations along the axis z of the amplitude Alpha(z) and of the phase Beta(z) of the leaky wave of the guide, allowing an antenna to be produced that has the desired radiating pattern.

2. The Leaky wave antenna according to claim 1, wherein the law of variation w(z) of the thickness of dielectric substrate bordering the inner face of each of the lateral walls of the cavity of the AFSIW guide is a linear law.

3. The Leaky wave antenna according to claim 1, wherein the thicknesses of dielectric substrate bordering the inner face of each of the lateral walls of the cavity of the AFSIW guide follow one and the same law of variation w(z).

4. The Leaky wave antenna according to claim 1, wherein the thickness of dielectric substrate bordering the inner face of one of the lateral walls of the cavity (323) of the AFSIW guide follows a linear law of variation w(z), the thickness of dielectric substrate bordering the inner face of the other lateral wall of the AFSIW guide being kept constant, even zero.

5. The Leaky wave antenna according to claim 1, wherein the aperture (52) forming the longitudinal radiating slot is positioned facing the longitudinal aperture (323) formed in the intermediate layer such that the median axis of the radiating slot (52) is distant from the median axis of the cavity (323) by a distance d.

6. The Leaky wave antenna according to claim 5, wherein the median axis (53) of the radiating slot is distant from the median axis (41) of the cavity of the guide, by a given distance d taken along an axis at right angles to the axis z and to an axis of stacking of the three layers of dielectric substrate.

7. The Leaky wave antenna according to claim 5, wherein the distance d(z) separating the median axis of the radiating slot from the median axis of the cavity of the guide varies along longitudinal axis z of the antenna, the distance d(z) being taken along an axis at right angles to the axis z and to an axis of stacking of the three layers of dielectric substrate.

8. The Leaky wave antenna according to claim 1, wherein the radiating slot is a rectangular slot of constant width wf.

9. The Leaky wave antenna according to claim 1, wherein the radiating slot (52) is a slot whose width wf(z) varies along the longitudinal axis z of the guide.

10. The Leaky wave antenna according to claim 1, wherein the total width W1 of the guide along the longitudinal axis z of the antenna is defined as a function W1(*z*).

11. The Leaky wave antenna according to claim 1, wherein the intermediate layer (32) comprises a longitudinal aperture (323) of length L and of width W2, forming the cavity of the waveguide, delimited by the conductive planes covering the bottom (31) and top (51) layers and by two rows of vias (322) in electrical contact with said conductive planes and forming the lateral walls of said waveguides, each of said rows of vias (322) being disposed so as to form one of the lateral walls of the guide, the inner face of the wall thus formed being coated with a layer of dielectric material of thickness w(z).

12. The Leaky wave antenna according to claim 1, wherein the intermediate layer (32) comprises a longitudinal aperture (323) of length L and of width W2, forming the cavity of the waveguide, delimited by the conductive planes covering the bottom (31) and top (51) layers; one of the lateral walls of said guide being formed by a row of vias (322) in electrical contact with said conductive planes, the other lateral wall being coated with a layer of conductive material, said row of vias (322) being disposed so as to form one of the lateral walls of the guide, the inner face of the wall thus formed being coated with a layer of dielectric material of thickness w(z).

* * * * *